US005246607A

United States Patent [19]

Schaefer et al.

[11] Patent Number: 5,246,607

[45] Date of Patent: Sep. 21, 1993

[54] METHYLPOLYSILOXANES WITH QUATERNARY AMMONIUM GROUPS AS CORROSION INHIBITORS FOR PREPARATIONS CONSISTING PREDOMINANTLY OF WATER

[75] Inventors: Dietmar Schaefer, Essen; Werner Höhner, Velbert, both of Fed. Rep. of Germany

[73] Assignee: Th. Goldschmidt AG, Essen, Fed. Rep. of Germany

[21] Appl. No.: 420,348

[22] Filed: Oct. 12, 1989

[30] Foreign Application Priority Data

Nov. 8, 1988 [DE] Fed. Rep. of Germany ..... 3837811

[51] Int. Cl.[5] ..... C23F 11/14

[52] U.S. Cl. ..... 252/389.32; 252/400.31; 252/403; 252/399; 252/389.31; 252/68; 252/78.3; 422/18; 556/418; 556/419; 556/413; 556/425

[58] Field of Search ..... 422/18; 252/400.31, 252/403, 399, 68, 389.31, 389.32, 78.3; 556/418, 419, 413, 425

[56] References Cited

U.S. PATENT DOCUMENTS

| | | | |
|---|---|---|---|
| Re. 30,885 | 3/1982 | Rieder | 562/451 |
| 3,085,908 | 4/1963 | Morehouse et al. | 106/14.42 |
| 3,121,692 | 2/1964 | Morehouse et al. | 252/78.3 |
| 3,203,969 | 8/1965 | Pines | 252/78.3 |
| 3,389,160 | 6/1968 | Reid | 556/423 |
| 3,402,191 | 9/1968 | Morehouse | 556/423 |
| 3,725,287 | 4/1973 | Traver | 252/78.3 |
| 4,185,087 | 1/1980 | Morlino | 252/DIG. 13 |
| 4,237,021 | 12/1980 | Andlid et al. | 252/49.5 |
| 4,239,539 | 12/1980 | Ginsberg et al. | 106/1.17 |
| 4,239,635 | 12/1980 | Rieder | 562/451 |
| 4,448,699 | 5/1984 | Barrat et al. | 252/8.75 |
| 4,537,691 | 8/1985 | Mori et al. | 252/78.3 |
| 4,585,563 | 4/1986 | Busch et al. | 252/174.15 |
| 4,639,321 | 1/1987 | Barrat et al. | 252/8.8 |
| 4,645,614 | 2/1987 | Glossens et al. | 252/78.3 |
| 4,844,888 | 7/1989 | Zawadzki | 525/477 |
| 4,891,166 | 1/1990 | Schaefer et al. | 556/425 |
| 4,894,175 | 1/1990 | Koerner et al. | 252/78.3 |

OTHER PUBLICATIONS

Bestimmung der Korrosionsschutzeigenschagten von wassergemischten Kühlschmierstoffen, Jul. 1981.

*Primary Examiner*—Robert L. Stoll
*Assistant Examiner*—Valerie Fee
*Attorney, Agent, or Firm*—Anderson, Kill, Olick & Oshinsky

[57] ABSTRACT

Methylpolysiloxanes are disclosed which have quaternary ammonium groups linked to silicon atoms via carbon atoms, wherein the ratio of the number of dimethylsiloxy groups to the number of quaternary ammonium groups has a value of 0.5 to 1.5. The methylpolysiloxanes are useful as corrosion inhibitors for preparations consisting predominantly of water, especially coolants, such as cooling lubricants mixed with water, in an amount of 0.01 to 0.1% by weight, based on the total preparation in the form suitable for use.

10 Claims, No Drawings

METHYLPOLYSILOXANES WITH QUATERNARY AMMONIUM GROUPS AS CORROSION INHIBITORS FOR PREPARATIONS CONSISTING PREDOMINANTLY OF WATER

BACKGROUND OF THE INVENTION

This invention is directed to corrosion inhibitors for metallic surfaces which come into contact with aqueous preparations and for a method of inhibiting corrosion of such metal surfaces. More particularly, this invention concerns methylpolysiloxanes which are effective corrosion inhibitors for such metallic surfaces.

Metallic surfaces which come into contact with aqueous preparations such as heat-transfer media, coolants, drilling and cutting oil emulsions, in the presence of oxygen, are easily corroded. To avoid such corrosion, numerous inhibitors known in the art are used, most of which contain nitrogen or phosphorus atoms.

For example, metal processing emulsions for metal shaping (cutting, shaping by deep drawing and rolling) are claimed in German Patent 2,907,863. These emulsions are of the oil-in-water type, have good stability, can be infinitely diluted and are based on triglyceride oils. As dermatologically safe wetting agents with a corrosion inhibiting effect, the emulsions contain alkanolamines with 2 to 4 carbon atoms in the alkanol portion or fatty acid salts thereof. In the same way, fatty amines which contain 8 to 18 carbon atoms are also supposed to prevent rust.

In German Patent 3,015,864, polyoxyalkylenediamides with terminal carboxylic acid groups and their salts are recommended as corrosion-inhibiting additives for metal processing emulsions. These products reportedly improve the lubricating properties of the preparation at the same time.

Compounds of the following structure are claimed in U.S. Pat. No. 3,389,160:

$$\begin{array}{l} \quad\;\; C_2H_4R'CH(OH)CH_2NR_2(R''X)_a \\ \quad\;\; | \\ R_3SiO(SiO)_x(R_2SiO)_ySiR_3 \\ \quad\;\; | \\ \quad\;\; R \end{array} \qquad \text{I}$$

In this formula

R is a univalent hydrocarbon group with up to 18 carbon atoms,

R′ is a divalent hydrocarbon group with up to 18 carbon atoms or a divalent hydrocarbon oxy group with up to 18 carbon atoms, the oxygen in the hydrocarbon oxy group being present in the form of an ether bond and the hydrocarbon portion of the hydrocarbon oxy group being present in the form of a divalent alkylene group, X is the anion of an acid, R″ is hydrogen or, when X is a halogen atom, either hydrogen or a group such as R a=0 or 1, x has an average value of 1 to about 100, y has an average value of 0 to about 1,000 and the ratio of y:x is not greater than 50:1.

Various applications have been indicated for compounds of general formula I.

Compounds of general formula $$\begin{array}{l} \quad\;\; C_2H_4R'CH(OH)CH_2NR_2 \\ \quad\;\; | \\ R_3SiO(SiO)_x(R_2SiO)_ySiR_3 \\ \quad\;\; | \\ \quad\;\; R \end{array} \qquad \text{II}$$

are useful as corrosion inhibitors for aqueous systems. It is a disadvantage, however, that these compounds have only very slight solubility in water, and as a result, these compounds must be emulsified or a solubilizer must be used in an aqueous system.

Compounds of the formulas $$\begin{array}{l} \quad\;\; C_2H_4R'CH(OH)CH_2NR_2H_+X_- \\ \quad\;\; | \\ R_3SiO(SiO)_x(R_2SiO)_ySiR_3 \\ \quad\;\; | \\ \quad\;\; R \end{array} \qquad \text{III}$$

and $$\begin{array}{l} \quad\;\; C_2H_4R'CH(OH)CH_2NR_3{}_+X_- \\ \quad\;\; | \\ R_3SiO(SiO)_x(R_2SiO)_ySiR_3 \\ \quad\;\; | \\ \quad\;\; R \end{array} \qquad \text{IV}$$

are reported to reduce the surface tension of water and to be surface active substances. It cannot be inferred from U.S. Pat. No. 3,389,160 that the compounds of formulas III and IV are usable for the purpose of inhibiting corrosion.

SUMMARY OF THE INVENTION

It is an object of the invention to provide organosilicon compounds which have improved corrosion inhibiting properties.

It is also an object of the invention to provide organosilicon compounds by means of which, aqueous systems with improved corrosion protection can be formulated, which are suitable particularly for dissipating heat.

These objectives are accomplished, according to the invention, by the discovery of methylpolysiloxanes having quaternary ammonium groups which are linked through carbon atoms to silicon atoms, wherein the ratio of the number of dimethylsiloxy groups to the number of ammonium groups has a value of 0.5 to 15. Such methylpolysiloxanes have been found to be highly effective corrosion inhibitors for preparations comprised predominantly of water, particularly coolants, such as cooling lubricants mixed with water, when present in an amount of 0.01 to 0.1% by weight, based on the total weight of the preparation.

DESCRIPTION OF THE INVENTION

Surprisingly, methylpolysiloxanes wherein the dimethylsiloxy groups and quaternary ammonium groups are in the required ratio, as set forth above, have outstanding corrosion inhibiting properties. The compounds are soluble or readily dispersible in water. They have a high chemical stability in aqueous solution and are effective in very small amounts. An amount of 0.01 to 0.1% by weight, based on the weight of the total preparation in the diluted form suitable for use, is usually sufficient to achieve good corrosion protection.

Preferred methylpolysiloxanes of the present invention have the general formula:

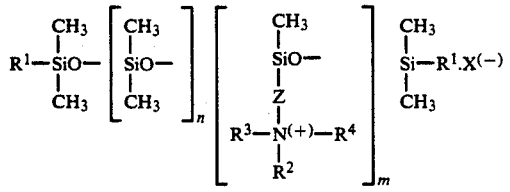

wherein $R^1$ is the same or different in the molecule and represents a methyl group or the

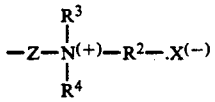

group, $R^2$ is the same or different in the molecule and represents an alkyl group with 1 to 18 carbon atoms or the $R^5$—CONH—$(CH_2)_3$— group, in which $R^5$ is an alkyl group with 7 to 17 carbon atoms, $R^3$ and $R^4$ are the same or different in the molecule and represent an alkyl group with 1 to 4 carbon atoms, Z is the

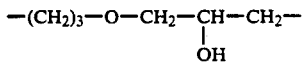

or

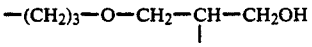

group, $X^{(-)}$ is an inorganic or organic anion, n has a value of 5 to 20, m has a value of 1 to 10, and the ratio of the number of dimethylsiloxy groups to the number of quaternary ammonium groups has a value of 0.5 to 15.

The inventive compounds thus are linear methylpolysiloxanes, which have lateral and optionally, additional terminal quaternary ammonium groups. These quaternary ammonium groups carry the $R^2$, $R^3$ and $R^4$ groups. The $R^2$ groups can have different meanings within the polymeric molecule. In this connection, $R^2$ is an alkyl group with 1 to 18 carbon atoms, such as the methyl, ethyl, propyl, isopropyl, butyl, isobutyl, hexyl, decyl, dodecyl or octadecyl group. $R^2$ may, however, also represent the $R^5$—CONH—$(CH_2)_3$— group. In this group $R^5$ is an alkyl group with 7 to 17 carbon atoms, which usually is derived from a fatty acid $R^5COOH$.

$R^3$ and $R^4$ may also be the same or different within the polymeric molecule and represent an alkyl group with 1 to 4 carbon atoms, such as the methyl, ethyl, propyl, isopropyl, butyl or isobutyl group.

The quaternary ammonium groups are linked via the Z group in each case to a silicon atom. The Z group corresponds to the formula

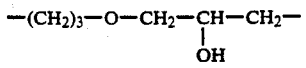

or

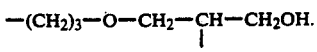

It follows from this that the Z group is linked to the silicon atom through an SiC bond and that the compounds according to the invention have high hydrolytic stability.

$X^{(-)}$ is the counter ion of the ammonium group, so that the number of the $X^{(-)}$ anions corresponds to the number of the quaternary nitrogen atoms. In this connection, X may be an inorganic or an organic anion. For reasons of economy and ready accessibility, X usually is an inorganic ion, such as a chloride ion. The acetate anion is an example of an organic anion.

Subscript n, which indicates the number of difunctional units, has a value of 5 to 20. On the other hand, m refers to the methylsiloxy groups, to which quaternary ammonium groups are linked laterally in the polymeric molecule; m has a value of 1 to 10. However, the condition must be fulfilled that the ratio of the number of dimethylsiloxy groups to the number of quaternary ammonium groups has a value of 0.5 to 15.

A further preferred embodiment of the invention are methylpolysiloxanes with quaternary ammonium groups of the general formula

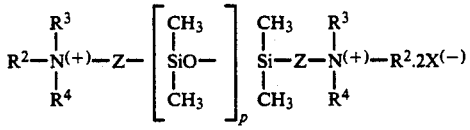

wherein $R^2$, $R^3$, $R^4$, $X^{(-)}$ and Z have the meanings set forth above and p has a value of 1 to 29.

As is evident from this formula, it is a question here of linear methylpolysiloxanes which have quaternary ammonium groups exclusively in the alpha, omega position. The $R^2$, $R^3$, $R^4$, $X^{(-)}$ and Z groups have the meaning already given. The subscript p has a value of 1 to 29.

If p has a value of 1, a ratio of $\frac{1}{2}=0.5$ is obtained. In this case, a disiloxane modified with quaternary ammonium groups in the alpha, omega positions is present.

Examples of particularly suitable compounds according to the invention are

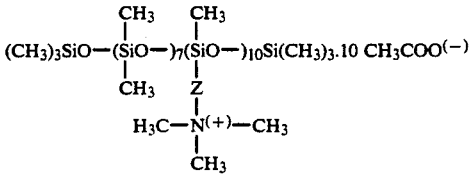

-continued

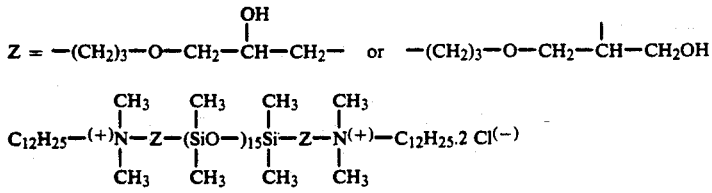

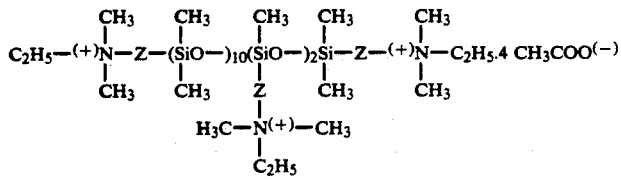

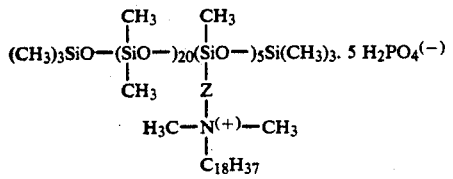

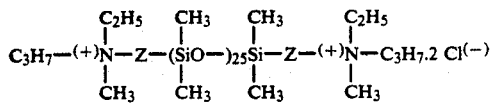

The methylpolysiloxanes which have quaternary ammonium groups and are used according to the invention are preferably added to conventional commercial concentrates of preparations. When the methylpolysiloxanes are used in heat transfer agents or coolants, the methylpolysiloxane can be dissolved, for example, in ethylene glycol; the stock solution is then diluted by the user to the correct concentration for the application. If the inventive compounds are used as corrosion inhibitors in metal processing emulsions, the siloxanes can be added to the concentrated, conventional commercial emulsion, the essential components of which are vegetable, synthetic or animal oils, water and an emulsifier. This stock emulsion is then diluted with water to the concentration for the application at the place where it is to be used. This stock emulsion is then diluted with water to the concentration for the application at the place where it is to be used.

The siloxanes which are used according to the invention can be synthesized, for example, according to the method of German Patent 3,719,086. For this method, siloxanes of the general formula

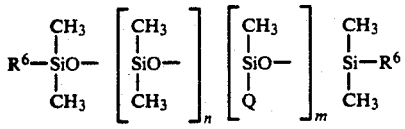

are used as starting compounds. In this formula, $R^6$ represents a methyl group or the Q group, the latter being

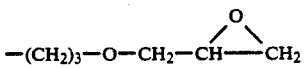

The remaining groups and subscripts have the meanings already given.

The starting compounds are reacted in a known manner with tertiary amines of the general formula

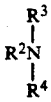

wherein $R^2$, $R^3$ and $R^4$ have the meanings already given. The reaction is carried out in the presence of one acid equivalent of HX, based on the nitrogen atoms to be quaternized, at a temperature of about 40° to 120° C. The compounds are light yellow to reddish products with a moderate to high viscosity.

The following Examples, which demonstrate the corrosion inhibiting properties of the siloxanes according to the invention, further illustrate the best mode currently contemplated for carrying out the invention, but must not be interpreted as limiting the invention in any manner.

The corrosion inhibiting properties are determined by the method of DIN 51 360, part 2, for testing cooling lubricants in accordance with the directions for determining the corrosion inhibiting properties of cooling lubricants mixed with water with the chips/filter paper method. For details of the determination, the DIN procedure should be referred to. In principle, the cooling lubricant, mixed with water, is furnished with the corrosion inhibitor. Cast iron test chips, which before the determination were tested visually for the absence of corrosion, are screened and the fraction having a total weight of 2 g. per 30±5 chips is used for carrying out the experiments. A circular filter paper is placed in an 80×20 mm. Petri dish. On the surface of this circular filter paper, 2 g. of the chips are distributed uniformly. The chips are wetted uniformly with 2 ml. of the aqueous preparation that is to tested. Subsequently, the cover is place on the Petri dish. The thus prepared Petri dishes are now exposed for two hours to a temperature of 8° to 22° C.

After that, the chips are removed, the circular filter paper is washed under running water, moved about in acetone for about 5 seconds and dried at room temperature. After that, the degree of corrosion of the corrosion outlines on the circular filter paper is determined by visual inspection. The results are evaluated according to the following classification set forth in Table 1.

TABLE 1

| Degree of Corrosion | Significance | Description (Surface of the Circular Filter Paper) |
|---|---|---|
| 0 | no corrosion | unchanged |
| 1 | traces of corrosion | no more than 3 corrosion outlines, none of which has a diameter greater than 1 mm. |
| 2 | slight corrosion | not more than 1% of the surface discolored, but more or larger corrosion outlines than for corrosion of degree 1 |
| 3 | moderate corrosion | more than 1%, but not more than 5% of the surface discolored |
| 4 | severe corrosion | more than 5% of the surface discolored |

The compounds, the corrosion-inhibiting properties of which are to be determined, are dissolved in an amount of 0.1% by weight in the cooling lubricant that is mixed with water. The following compounds were investigated and rated:

COMPOUND 1 OF THE INVENTION

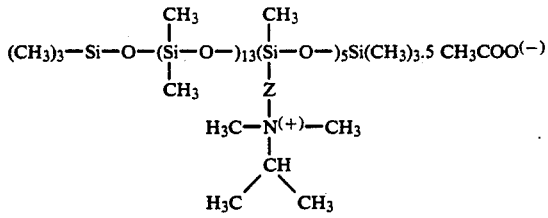

COMPOUND 2 OF THE INVENTION

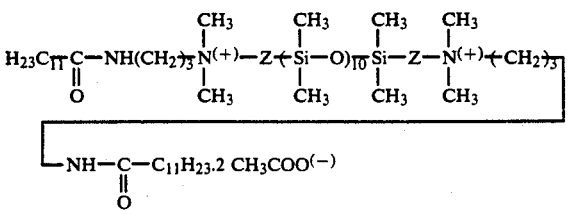

COMPOUND 3 FOR COMPARISON, NOT OF THE INVENTION

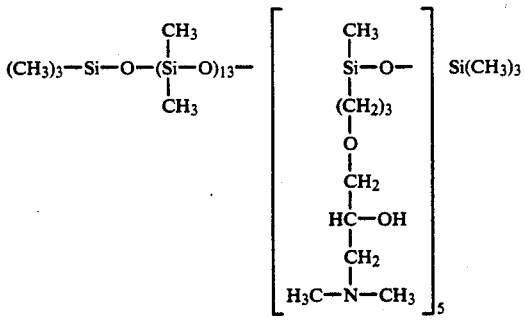

COMPOUND 4 FOR COMPARISON, NOT OF THE INVENTION

Polydiethanolamides of fatty acids ($C_{12} \rightarrow C_{18}$), commercially available under the name of Comperlan PD.

COMPOUND 5 FOR COMPARISON, NOT OF THE INVENTION

Polydiethanolamides of fatty acids (vegetable oils), commercially available under the name of Comperlan PVD.

COMPOUND 6 FOR COMPARISON, NOT OF THE INVENTION

Amine soap/fatty acid mixture, commercially available under the name of Texamin KL.

TABLE 2

| Compound | Rating |
|---|---|
| 1 | 1 |
| 2 | 1 |
| 3 | 2 |
| 4 | 2 |
| 5 | 3 |
| 6 | 3 |
| no addition of active substance | 4 |

We claim:

1. A method for inhibiting the corrosion of a metallic surface in contact with an aqueous solution comprising adding a corrosion inhibitor comprised of methylpolysiloxane having quaternary ammonium groups linked to silicon atoms via carbon atoms to the aqueous solution in an amount of 0.01 to 0.1% by weight of the aqueous solution in contact with the metal surface, wherein the ratio of the number of dimethylsiloxy groups to the number of quaternary ammonium groups in the methylpolysiloxane has a value of 0.5 to 15.

2. The method of claim 1, in which the methylpolysiloxane is of the formula

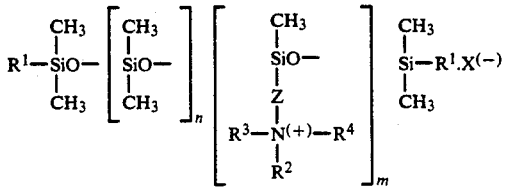

wherein $R^1$ is the same or different in the molecule and represents a methyl group or the

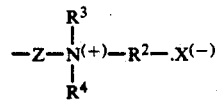

group, $R^2$ is the same or different in the molecule and represents an alkyl group with 1 to 18 carbon atoms or the $R^5$—CONH—$(CH_2)_3$— group, in which $R^5$ is an alkyl group with 7 to 17 carbon atoms, $R^3$ and $R^4$ are the same or different in the molecule and represent an alkyl group with 1 to 4 carbon atoms, Z is the

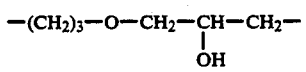

or

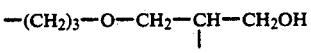

group, $X^{(-)}$ is an inorganic or organic anion, n has a value of 5 to 20, m has a value of 1 to 10, and the ratio of the number of dimethylsiloxy groups to the number of quaternary ammonium groups has a value of 0.5 to 15.

3. The method of claim 1, in which the methylpolysiloxane is of the formula

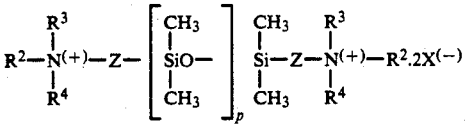

wherein $R^2$ is the same or different in the molecule and represents an alkyl group with 1 to 18 carbon atoms or the $R^5$—CONH—$(CH_2)_3$— group, in which $R^5$ is an alkyl group with 7 to 17 carbon atoms, $R^3$ and $R^4$ are the same or different in the molecule and represent an alkyl group with 1 to 4 carbon atoms, Z is the

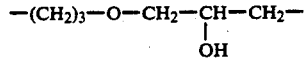

or

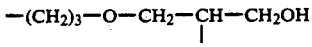

group, $X^{(-)}$ is an inorganic or organic anion, and p has a value of 1 to 29.

4. The method of claim 1, in which the methylpolysiloxane is added to a concentrate of the aqueous solution in an amount of 0.01 to 0.1% by weight based on the total weight of aqueous solution when in contact with the metal surface.

5. The method of claim 1, in which the aqueous solution is a coolant comprised principally of water.

6. A composition effective to inhibit corrosion of metal surfaces comprising a methylpolysiloxane of the formula

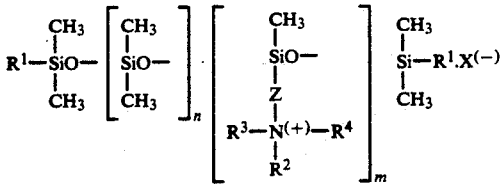

wherein $R^1$ is the same or different in the molecule and represents a methyl group or the

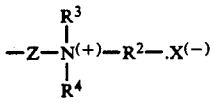

group, $R^2$ is the same or different in the molecule and represents an alkyl group with 1 to 18 carbon atoms or the $R^5$—CONH—$(CH_2)_3$— group, in which $R^5$ is an alkyl group with 7 to 17 carbon atoms, $R^3$ and $R^4$ are the same or different in the molecule and represent an alkyl group with 1 to 4 carbon atoms, Z is the

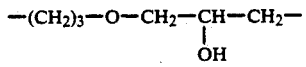

or

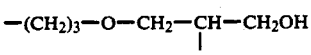

group, $X^{(-)}$ is an inorganic or organic anion, n has a value of 5 to 20, m has a value of 1 to 10, and the ratio of the number of dimethylsiloxy groups to the number of quaternary ammonium groups has a value of 0.5 to 15, in an aqueous solution in an amount of 0.01 to 0.1% by weight based on the total weight of aqueous solution when in contact with the metal surface.

7. A composition effective to inhibit corrosion of metal surfaces comprising a methyl polysiloxane of the formula

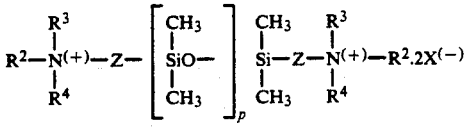

wherein $R^2$ is the same or different in the molecule and represents an alkyl group with 1 to 18 carbon atoms or the $R^5$—CONH—$(CH_2)_3$— group, in which $R^5$ is an alkyl group with 7 to 17 carbon atoms, $R^3$ and $R^4$ are the same or different in the molecule and represent an alkyl group with 1 to 4 carbon atoms, Z is the $$-(CH_2)_3-O-CH_2-\underset{\underset{OH}{|}}{CH}-CH_2-$$

or

-continued $$-(CH_2)_3-O-CH_2-\underset{\underset{|}{}}{CH}-CH_2OH$$

group,

X (−) is an inorganic or organic anion, and p has a value of 1 to 29;

in an aqueous solution in amount of 0.01 to 0.1% by weight based on the total weight of aqueous solution when in contact with the metal surface.

8. The composition according to claim 6, in which the aqueous solution is a concentrate and the methylpolysiloxane is present in an amount of 0.01 to 0.1% by weight based on the total weight of aqueous solution when in contact with the metal surface.

9. The composition according to claim 6, in which the aqueous solution also contains coolant.

10. The composition according to claim 7, in which the aqueous solution also contains coolant.

* * * * *